US009605547B2

(12) United States Patent
Evain et al.

(10) Patent No.: US 9,605,547 B2
(45) Date of Patent: Mar. 28, 2017

(54) TURBINE ENGINE WHEEL, IN PARTICULAR FOR A LOW PRESSURE TURBINE

(71) Applicant: SNECMA, Paris (FR)

(72) Inventors: Gael Evain, Moissy Cramayel (FR); Didier Fabre, Moissy Cramayel (FR)

(73) Assignee: SNECMA, Paris (FR)

( * ) Notice: Subject to any disclaimer, the term of this patent is extended or adjusted under 35 U.S.C. 154(b) by 379 days.

(21) Appl. No.: 14/291,278

(22) Filed: May 30, 2014

(65) Prior Publication Data

US 2014/0356173 A1 Dec. 4, 2014

(30) Foreign Application Priority Data

May 30, 2013 (FR) ..... 13 54936

(51) Int. Cl.

| | |
|---|---|
| ***F01D 5/10*** | (2006.01) |
| ***F01D 11/00*** | (2006.01) |
| ***F01D 5/26*** | (2006.01) |
| ***F01D 5/30*** | (2006.01) |

(52) U.S. Cl.

CPC ..... *F01D 5/30* (2013.01); *F01D 5/10* (2013.01); *F01D 5/26* (2013.01); *F01D 11/006* (2013.01); *F01D 11/008* (2013.01); *F05D 2300/6033* (2013.01)

(58) Field of Classification Search

CPC ..... F01D 5/30; F01D 5/10; F01D 5/26; F01D 11/008; F01D 11/006; F05D 2300/6033

USPC ..... 416/220 R, 193 A

See application file for complete search history.

(56) References Cited

U.S. PATENT DOCUMENTS

| | | | | |
|---|---|---|---|---|
| 4,723,889 | A | 2/1988 | Charreron et al. | |
| 5,388,962 | A * | 2/1995 | Wygle | F01D 5/082 416/220 R |
| 2012/0269650 | A1 | 10/2012 | Berche et al. | |

(Continued)

FOREIGN PATENT DOCUMENTS

| | | |
|---|---|---|
| FR | 2 585 069 A1 | 1/1987 |
| FR | 2 972 759 A1 | 9/2012 |
| GB | 2 490 216 | 10/2012 |

OTHER PUBLICATIONS

French Preliminary Search Report issued Feb. 24, 2014 in French Application 13 54936, filed on May 30, 2013 ( with English Translation of categories of Documents and Written Opinion).

*Primary Examiner* — Marina Tietjen

(74) *Attorney, Agent, or Firm* — Oblon, McClelland, Maier & Neustadt, L.L.P.

(57) ABSTRACT

A turbine engine wheel, in particular for a low pressure turbine, is provided. The wheel includes blades, each including an airfoil connected by a platform to a middle wall or tang extending radially and itself extended radially inwards by a root mounted in a slot of a disk, the platform and the tang defining two side cavities arranged on either side of the tang, which cavities are circumferentially open and are situated facing corresponding cavities in the directly adjacent blades, and sealing members being housed in the cavities adjacent to the blades. An annular sealing end plate is mounted on the upstream or downstream end of the disk, between the platforms and the disk, so as to face the slots and the roots of the blades, and includes a rotary coupling device for coupling with at least one of the sealing members.

9 Claims, 5 Drawing Sheets

(56) References Cited

U.S. PATENT DOCUMENTS

2013/0156590 A1* 6/2013 Blanchard ..... F01D 5/3069
416/220 R

* cited by examiner

TURBINE ENGINE WHEEL, IN PARTICULAR FOR A LOW PRESSURE TURBINE

The present invention relates to a turbine engine wheel, and in particular a low pressure turbine wheel.

Such a wheel comprises a disk carrying metal blades having roots engaged in slots in the periphery of the disk.

In an embodiment known from patent application FR 2 972 759 in the name of the Applicant, each blade of a turbine wheel comprises an airfoil connected by a platform to a middle wall or tang extending radially and itself extended radially inwards by a root mounted in a slot of a disk, the platform and the tang defining two side cavities arranged on either side of the tang, which cavities are circumferentially open and are situated facing corresponding cavities of the directly adjacent blades.

The platform comprises a main wall in the form of a portion of a cylinder, a portion of a cone, or a three-dimensional geometrical portion, that is extended upstream by an upstream rim extending radially and circumferentially, itself extended by a lip extending upstream. The downstream portion of the main wall forms a downstream lip. A downstream end plate extends radially between the downstream lip and the disk. The upstream rim and the downstream end plate serve in particular to perform a sealing function.

The slots in the disk are regularly distributed around the axis of the disk, and between them they define teeth. In the assembled position, the platforms of the blades are arranged circumferentially beside one another and they surround the teeth of the disk.

The longitudinal edges of the platforms of the blades are spaced apart in the circumferential direction by small amounts of clearance. Sealing members, which may be referred to as "plugs", are mounted in the above-mentioned side cavities of the blades and, in operation, they are urged radially outwards by centrifugal forces and they come to bear radially against the radially inner faces of the main walls platforms in order to limit any leakage of gas between the longitudinal edges of the platforms. These sealing members can also serve to damp the vibration to which the blades are subjected in operation.

Each sealing member has a circumferential end portion engaged in the side cavity of the platform of one blade and an opposite circumferential end portion engaged in the side cavity of the platform of an adjacent blade.

A shroud is generally mounted upstream from the disk and includes an outer peripheral portion carrying an annular ring bearing axially against the upstream faces of the blade roots and of the teeth of the disk in order to hold the blades on the disk and prevent them from moving axially upstream. The ring is split and is engaged in an annular groove situated radially inside of the blade platforms so as to retain the blades on the disk against moving axially upstream.

In operation, cooling air is taken upstream from the turbine and flows from upstream to downstream in an annular space defined by the disk and the upstream end plate, and then flows axially in longitudinal passages that extend between the roots of the blades and the bottoms of the slots in the disk, so as to ventilate the teeth of the disk.

Recent developments have led to using blades that are made of ceramic matrix composite (CMC) material. The use of this type of material serves to reduce the weight of the blades and to increase their ability to withstand high temperatures, however it also requires the shape of the blades to be revised, and in particular the shape of the platforms. It is relatively complicated to make a platform having a structure similar to that of the prior art (main wall extended by a radial rim, itself extended by an axial upstream lip), since such a structure gives rise in particular to problems of twisting the fibers of the material during fabrication.

Naturally, this problem of simplifying the structure of the platforms could also arise with other types of blades.

A particular object of the invention is to provide a solution to this problem that is simple, effective, and inexpensive, by proposing a turbine engine wheel having blades, e.g. CMC blades, with a structure that can be simplified, while still providing the above-mentioned sealing functions.

To this end, the invention provides a turbine engine wheel, in particular for a low pressure turbine, the wheel having blades, each comprising an airfoil connected by a platform to a middle wall or tang extending radially and itself extended radially inwards by a root mounted in a slot of a disk, the platform and the tang defining two side cavities arranged on either side of the tang, which cavities are circumferentially open and are situated facing corresponding cavities in the directly adjacent blades, sealing members being housed in the cavities adjacent to the blades, the wheel being characterized in that it includes at least one annular sealing end plate mounted on the upstream or downstream end of the disk, said end plate extending radially between the platforms and the disk, so as to face the slots and the roots of the blades, said end plate including rotary coupling means for coupling with at least one of the sealing members.

The annular end plate thus performs the sealing function between the platforms of the blades and the disk, such that the structure of the platform can be considerably simplified. It is then possible to use blades made of CMC.

In order to prevent the end plate from turning, it is coupled in rotation to at least one of the sealing members.

According to a characteristic of the invention, the end plate includes a projecting portion engaged in a housing of complementary shape in the corresponding sealing member, or vice versa.

Under such circumstances, the projecting portion is a peg, e.g. of square or rectangular section.

Preferably, the radially inner periphery of the end plate is fastened to the upstream or downstream end of the disk by a twist-lock type coupling.

A twist-lock type coupling involves the presence of projecting or recessed portions (teeth, crenellations, or festoons) in the radially inner periphery of the end plate and suitable for co-operating with complementary recessed or projecting portions of the disk so as to allow the end plate to be mounted axially on the disk (with the projecting portions passing through the recessed portions) while the end plate is in at least one first angular position relative to the disk, and so as to allow the end plate to be prevented from moving axially relative to the disk (the projecting portions then bearing against abutments of the disk or of the end plate), in at least one second angular position of the end plate relative to the disk.

According to another characteristic of the invention, the end plate includes an annular lip extending axially upstream.

Such a lip serves in particular to define the flow passage for the hot gas passing through the turbine.

The blade may be made entirely out of a ceramic matrix composite material, or CMC.

As mentioned above, the use of such a material enables the weight of the blades to be reduced and enables their ability to withstand high temperatures to be increased. It should be recalled that the hot gas flowing through the turbine generally has a temperature lying in the range 600° C. to 1200° C.

The sealing member may also be made of metal, and it may for example be hollow or solid.

The radially outer portion of the end plate may bear axially against the sealing members and it may be spaced apart from the roots and the platforms of the blades.

Such a structure presents a particular advantage when the blades are made of CMC and the end plate and the sealing members are made of metal. Under such circumstances, the blades are relatively poor at withstanding rubbing against metal parts. By avoiding any contact between the roots or the platforms of the blades made of CMC and the metal end plate, it is possible to increase the lifetime of the blades.

Preferably, the end plate includes sealing means, such as an O-ring gasket for example, which sealing means are arranged between the end plate and the disk, radially outside the bottoms of the slots for mounting the roots of the blades.

Under such circumstances, the cooling air taken from upstream of the turbine can penetrate via openings provided in the radially inner periphery of the end plate (e.g. the recessed portions used for twist-lock coupling of the end plate on the disk), can flow between the end plate and the upstream or downstream face of the disk, and can then penetrate into the bottoms of the slots so as to cool the teeth of the disk.

In an embodiment of the invention, the turbine engine wheel includes two annular sealing end plates respectively mounted on the upstream end and the downstream end of the disk, each end plate extending radially between the platforms of the blades and the disk, so as to face the slots and the roots of the blades. Under such circumstances, at least one of the end plates may include rotary coupling means for coupling with at least one of the sealing members.

The invention can be better understood and other details, characteristics, and advantages of the invention appear on reading the following description made by way of non-limiting example and with reference to the accompanying drawings, in which.

Figure 1:
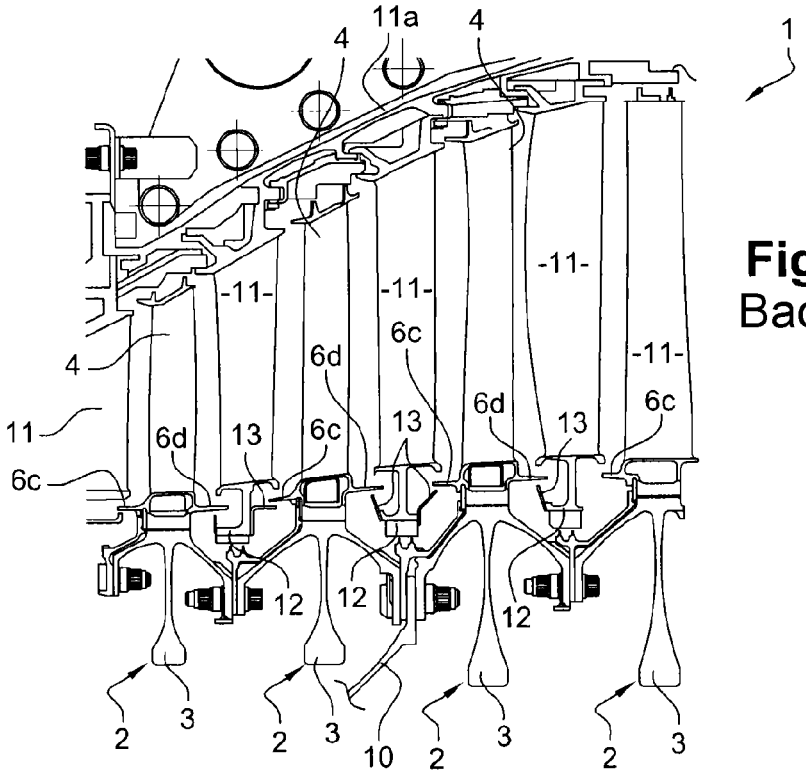
Fig. 1 Background Art
FIG. 1 is a fragmentary diagrammatic half-view in axial section of a low pressure turbine of a turbine engine.

Reference is made initially to FIG. 1 which is a diagrammatic half-view in section of a low pressure turbine 1 of a turbine engine, on a plane containing the axis of rotation of the rotor of the turbine 1.

The low pressure turbine rotor has four wheels 2 assembled together axially by annular flanges and each comprising a disk 3 carrying individual blades 4. As can be seen better in FIG. 2, each of these blades 4 comprises an airfoil 5 connected by a platform 6 to a middle wall or tang 7 extending radially and itself extended radially inwards by a root 8 that is engaged in a slot of the disk 3.

Between them, the slots housing the roots 8 of the blades 4 define teeth that are surrounded by the platforms 6 of the blades 4. The rotor is connected to the shaft of the turbine via a drive cone 10.

Annular rows of stator vanes 11 are located between the wheels 2, the vanes 11 being mounted by appropriate means at their radially outer ends to a casing 11*a* of the low pressure turbine. The stator vanes 11 in each row are connected together at their radially inner ends by annular sectors 12 placed circumferentially end to end.

Upstream and downstream circumferential lips or rims 13 are formed projecting axially from the annular sectors 12 and constitute baffles in association with other upstream and downstream circumferential lips or rims 6*c* and 6*d* of the platforms 6 of the blades 4 in order to limit the extent to which combustion gas coming from the combustion chamber upstream from the turbine 1 can pass radially from the outside towards the inside.

Figure 2:
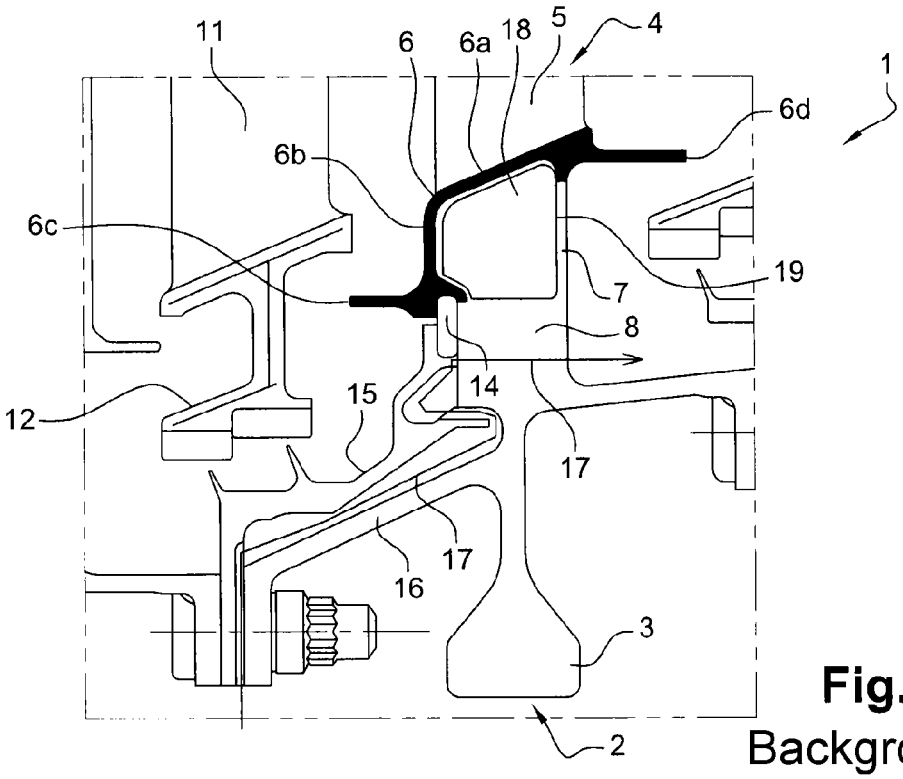
Fig. 2 Background Art
FIG. 2 is a fragmentary diagrammatic half-view in axial section on a larger scale of a portion of the FIG. 1 turbine, and it shows a prior art turbine wheel.
Figure 3:
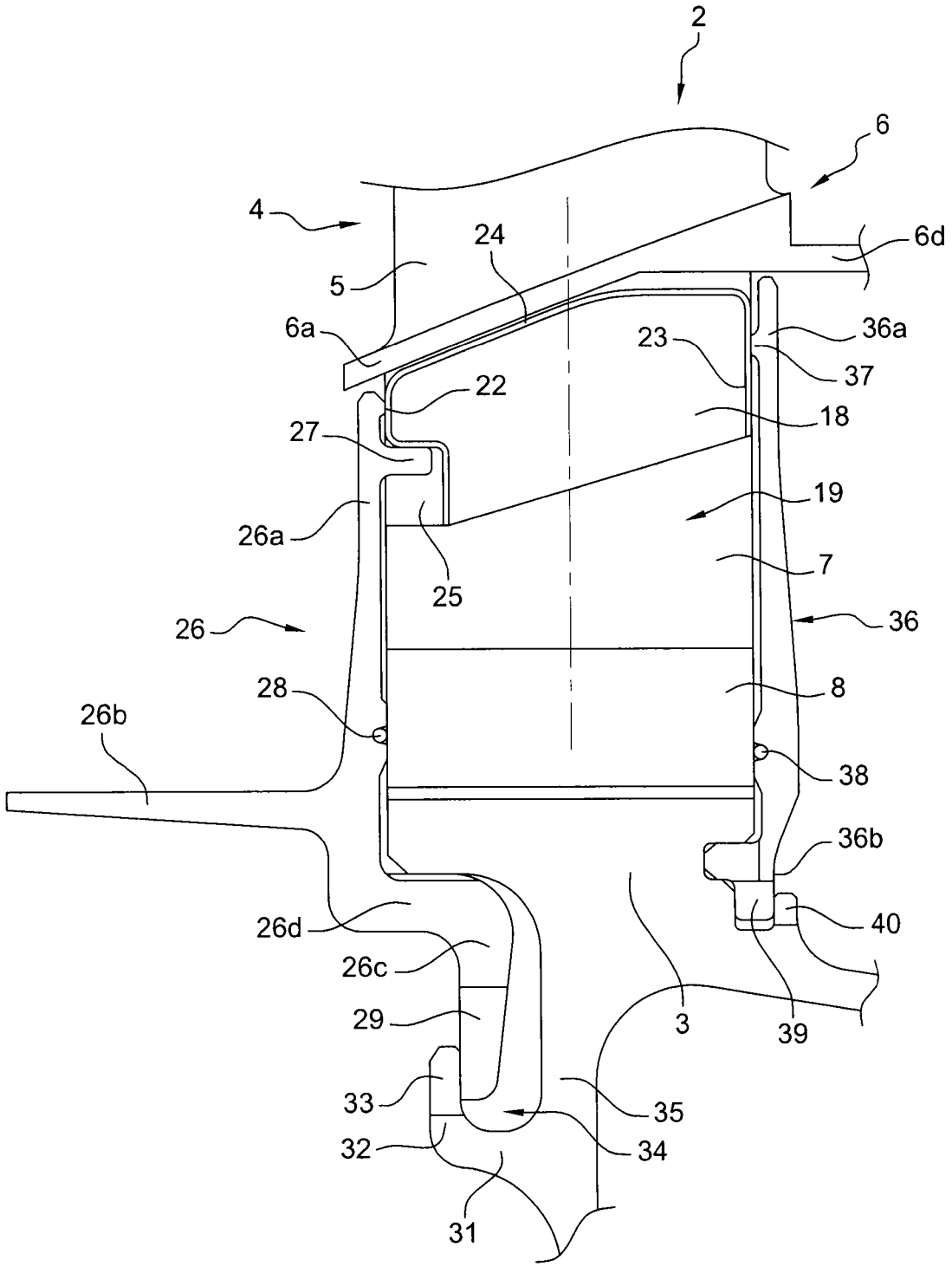
FIG. 3 is a half-view in axial section of a portion of a turbine engine wheel in an embodiment of the invention.
Figure 4:
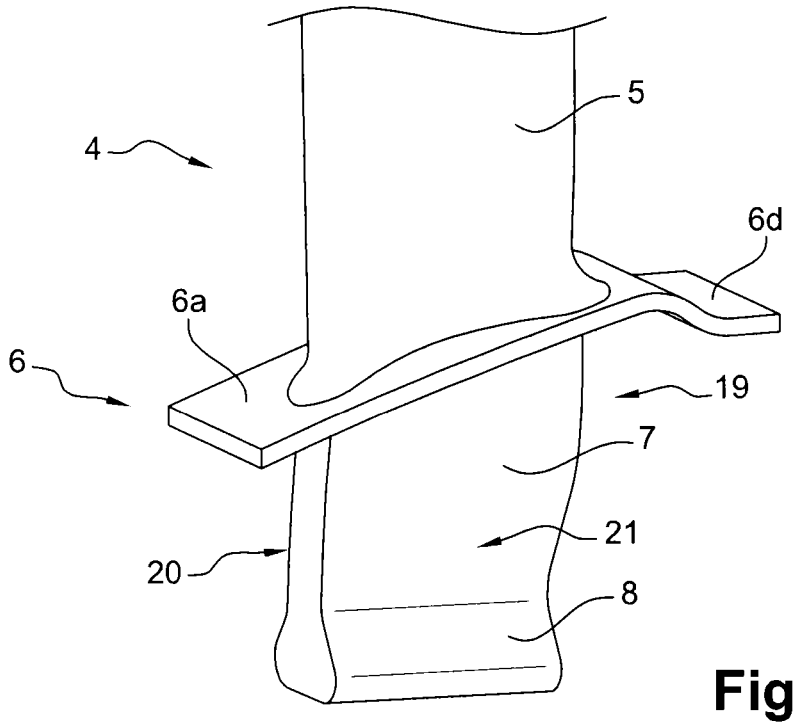
FIG. 4 is a perspective view of a portion of a blade of the wheel of the invention.
Figure 5:
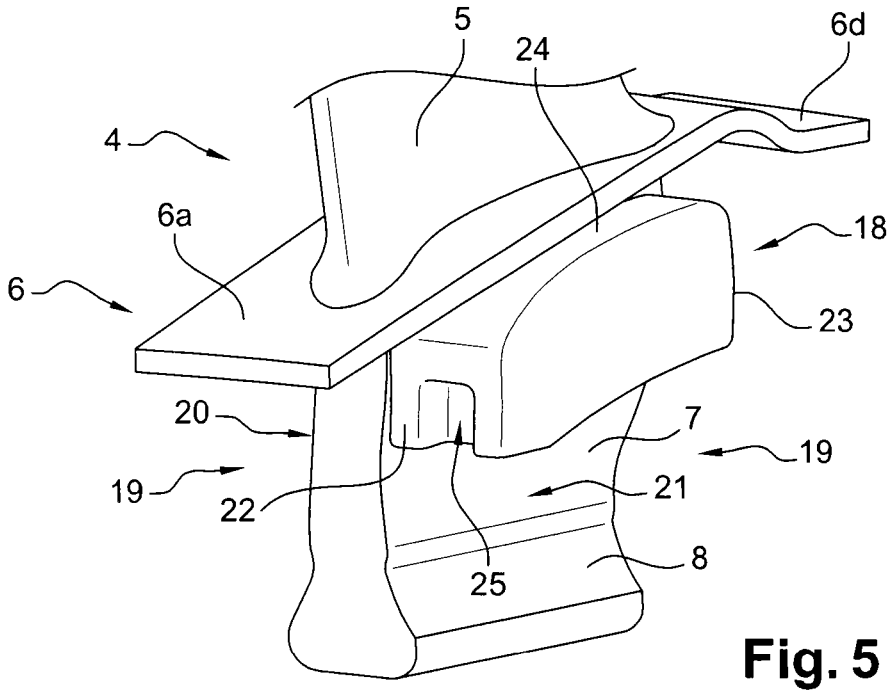
FIG. 5 is a perspective view of the FIG. 4 blade, a sealing member being inserted in one of the cavities of the blade.
Figure 6:
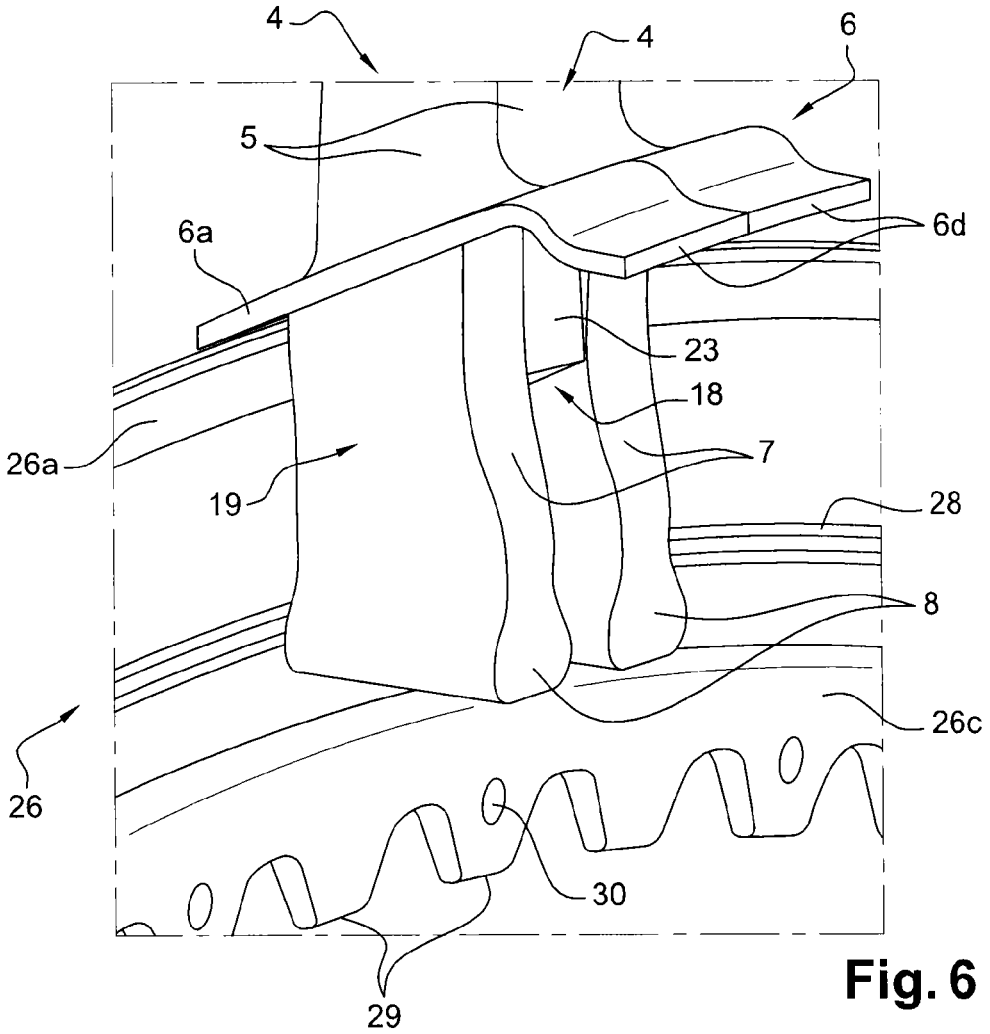
FIG. 6 is a perspective view showing the positioning of the sealing member between two blades, an end plate being arranged upstream from the blades.
Figure 7:
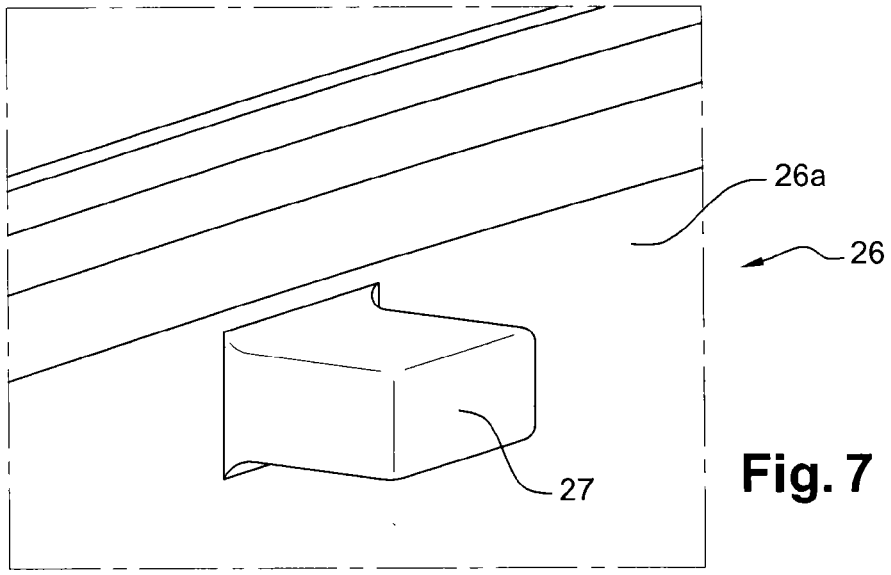
FIG. 7 is a perspective view showing a rotary coupling peg of the end plate.
Figure 8:
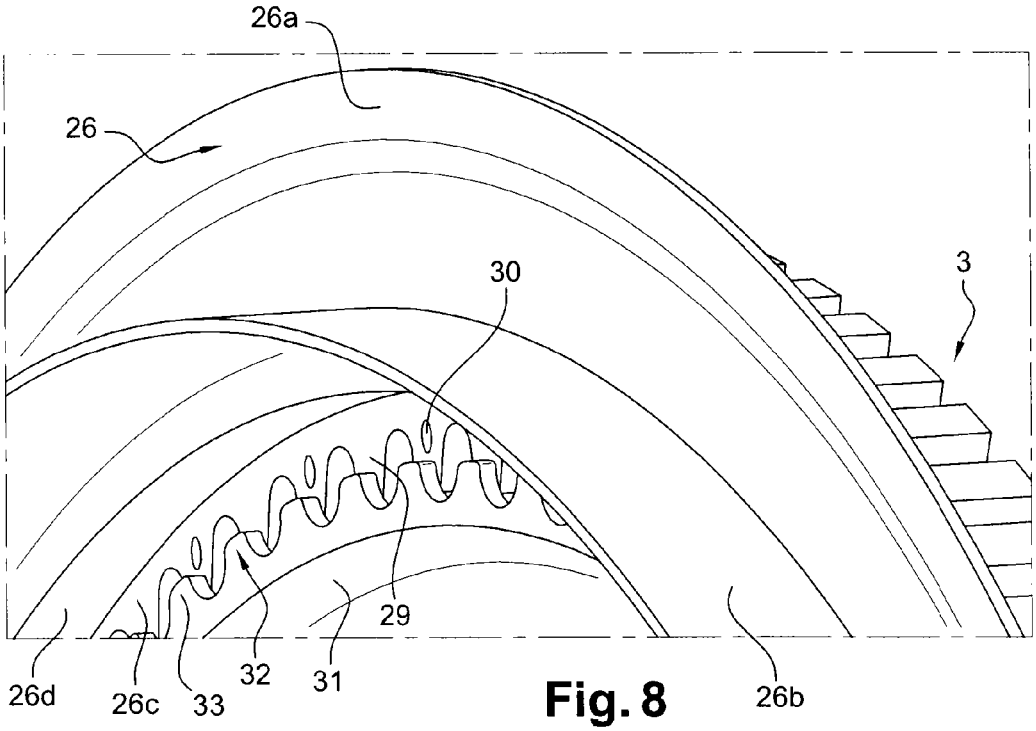
FIG. 8 is a perspective view showing the positioning of the end plate relative to the disk of the wheel of the invention.
Figure 9:
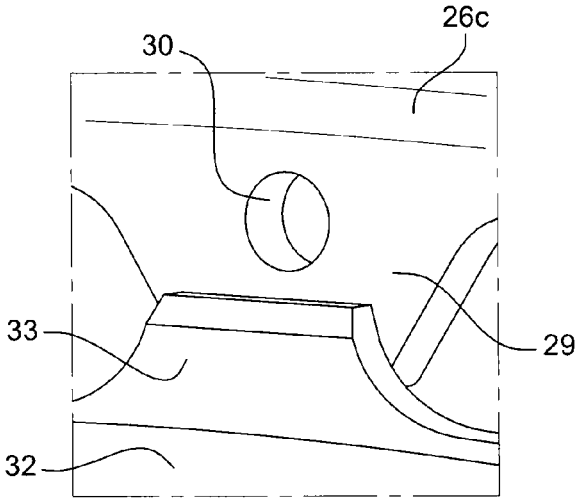
FIG. 9 is a detail view in perspective of a portion of the end plate and of the disk.

As can be seen more clearly in FIG. 2, each platform 6 has a main wall 6*a* in the form of a portion of a cylinder, a portion of a cone, or a three-dimensional geometrical portion that is extended upstream by an upstream rim 6*b* extending radially and circumferentially, and itself extended by a lip 6*c* extending upstream. The downstream portion of the main wall forms a downstream lip 6*d*.

The blades 4 are held axially on the disk 3 by means of an annular ring 14 that is mounted on the upstream end of the disk 3 and that is pressed axially against the upstream faces of the blade roots 8 and of the teeth of the disk 3 by an annular shroud 15 secured to the disk 3.

The shroud 15 extends around an upstream flange 16 of the disk 3 and co-operates therewith to define an annular space for passing a flow of air for ventilating the teeth of the disk (arrow 17). This air then penetrates into longitudinal passages that extend between the blade roots 8 and the bottoms of the slots in the disk 3.

It is known to mount sealing members 18 that may be referred to as plugs between the blades 4 in facing side cavities 19 of the platforms 6 of the blades 4. Each sealing member 18 is mounted between two adjacent blades 4 and includes a circumferential end portion housed in the side cavity 19 of one blade 4 and an opposite circumferential end portion housed in the side cavity 19 of an adjacent blade 4. These sealing members 18 fit closely to the inside shape of the cavities 19 with little clearance.

In operation, these sealing members 18 are subjected to centrifugal forces and they are urged radially against the inside faces of the main walls 6*a* of the platforms 6, thus preventing hot gas from passing radially from the main flow passage through the zones where the sealing members press against the platforms.

As mentioned above, recent developments have led to using blades 4 made of ceramic matrix composite (CMC) material. The use of this type of material serves to reduce the weight of the blades 4 and to increase their ability to withstand high temperatures, but it also requires the shape of the blades 4 to be revised, and in particular the shape of the platforms 6. It is rather complicated to make a platform 6 having a structure similar to that of the prior art (main wall 6*a* extended by a radial rim 6*b*, itself extended by an axial upstream lip 6*c*), since such a structure gives rise in particular to problems of twisting the fibers of the material during fabrication. Naturally, this problem of simplifying the structure of the platforms 6 could also arise with other types of blade.

In order to address the constraints associated with using a ceramic matrix composite material, the invention proposes a wheel 2 for a low pressure turbine 1 as shown in FIGS. 3 to 9.

As before, this wheel 2 comprises blades 4, each having an airfoil 5 connected by a platform 6 to a middle wall or tang 7 extending radially and itself extended radially inwards by a root 8 mounted in a slot of a disk 3. The blade 6 and the tang 7 define two side cavities 19 arranged one either side of the tang 7, which cavities 19 are circumferentially open and are and situated facing corresponding cavities 19 in the directly adjacent blades 4.

Each platform 6 has a frustoconical main wall 6*a* extended downstream by a lip 6*d* that extends axially downstream. The platform 6 thus does not have an upstream radial rim 6*b* or an upstream lip 6*c*. The tang 7 of each blade 4 has opposite side walls 20 and 21 that are respectively convex and concave.

Metal sealing members 18 are housed in the cavities 19 adjacent to the blades 4. Each sealing member 18 may be solid or hollow and it has upstream and downstream radial walls 22 and 23, convex and concave side walls of shapes complementary to the corresponding walls 20 and 21 of the tangs 7 of the adjacent blades 4, and a frustoconical radially outer wall 24 of shape corresponding to the radially inner surfaces of the main walls 6*a* of the adjacent blades 4. A housing 5 of rectangular or square section is formed in the upstream radial wall 22 of at least one of the sealing members 18. This housing 25 opens out in the radially inner edge of the upstream wall 22.

Such a housing 25 is preferably formed in at least two, and in particular in three, of the sealing members 18 that are regularly distributed around the circumference of the turbine wheel 2 for balancing reasons.

The sealing members 18 extend radially over a fraction only of the height of the corresponding cavities 19.

An annular metal upstream end plate 26 is mounted on the upstream end of the disk 3. The upstream end plate 26 has a radially outer portion 26*a* extending radially. The radially outer portion 26*a* bears against the upstream walls 22 of the sealing members 18 and it is spaced apart from the platforms 6, the tangs 7, and the roots 8 of the blades 4. This spacing is large enough to avoid contact between the blades 4 made of CMC and the metal end plate 26 in spite of the phenomena of differential expansion that can occur in operation, thereby making it possible to increase the lifetime of the blades 4.

One or more studs 27 of square or rectangular section extend axially downstream from the downstream surface of the radially outer portion 26*a*. The stud(s) 27 are engaged in the housing 25 of complementary shape in the corresponding sealing members 18 so as to prevent the end plate 26 turning relative to the sealing members 18. This spacing between the end plate and the root or the tang of the CMC blade serves to avoid applying any highly localized force against this portion of the blade and thus to avoid damaging the CMC blade.

An O-ring gasket 28 is engaged in a groove formed in the downstream face of the radially outer portion 26*a* of the end plate 26, the gasket 28 bearing against the teeth of the disk 3 and against the roots 8 of the blades 4, radially outwards relative to the bottom of the slots in the disk 3.

The end plate 26 also has an annular lip 26*b* extending axially upstream from the outer portion 26*a*, and a radially inner portion 26*c* extending radially and offset axially downstream relative to the radially outer portion 26*a* so as to form a cylindrical shoulder 26*d*.

The radially inner periphery of the inner portion 26*c* includes a set of teeth, the teeth 29 being of sections that are generally trapezoidal. Some of the teeth 29 are pierced by axial holes 30 for receiving studs of a tool (not shown) that is used for mounting the end plate 26 on the disk 3.

The disk 3 also has a cylindrical rim 31 extending upstream with its free end being in the form of a toothed ring 32 with teeth 33 extending radially outwards from the rim 31. A groove 34 is thus defined by the ring 32, the rim 31, and a radial portion 35 of the disk 3. The groove 34 is situated downstream from the toothed ring 32. Between them, the teeth 33 of the ring 32 define hollow zones suitable for passing the teeth 29 of the end plate 26, so that it is possible to insert the radially inner portion 26*c* of the end plate 26 axially into the groove 34, downstream from the ring 32. Once inserted in this way, the end plate 26 is turned relative to the disk 3 through an angle of determined value so as to position the teeth 29 of the end plate 26 in register with the teeth 33 of the ring 32, and thus prevent the end plate 26 being removed accidentally (see FIGS. 8 and 9). This forms a kind of twist-lock coupling.

The wheel 2 also has an annular metal end plate 36 arranged downstream, mounted against the downstream portion of the disk 3 and extending generally radially. It has a radially outer portion 36*a* with an annular projection 37 bearing against the downstream walls 23 of the sealing members 18. The downstream end plate 36 is also axially spaced apart from the platforms 6, the tangs 7, and the roots 8 of the blades 4. As above, this spacing is large enough to prevent any contact between the CMC blades 4 and the metal end plate 36, in spite of differential expansion phenomena that can occur in operation, thereby enabling the lifetime of the blades 4 to be lengthened. An O-ring gasket 38 is engaged in a groove formed in the upstream face of the downstream end plate 36, the gasket bearing against the teeth of the disk 3 and against the roots 8 of the blades 4, in a position that is radially on the outside of the bottoms of the slots in the disk 3. The downstream end plate 36 also has a radially inner portion 36*b* that is fastened by a twist-lock coupling to the disk 3, by means of teeth 39 formed at the radially inner periphery of the downstream end plate 36 and a corresponding toothed ring 40 situated at the downstream portion of the disk 3.

In operation, cooling air is taken upstream of the turbine and can penetrate between the teeth 29, 33 of the upstream end plate 26 and the corresponding toothed ring 32 of the disk 3 so as to flow between the end plate 26 and the upstream face of the disk 3, and then penetrate into the bottoms of the slots so as to cool the teeth of the disk 3. This air then escapes downstream between the teeth 39 of the downstream end plate 36 and the corresponding toothed ring 40 of the disk 3.

The invention claimed is:

1. A turbine engine wheel comprising:

blades, each comprising an airfoil connected by a platform to a middle wall or tang extending radially and the tang extended radially inwards by a root mounted in a slot of a disk, the platform and the tang defining two side cavities arranged on either side of the tang, wherein said cavities are circumferentially open and are situated facing corresponding cavities in directly adjacent blades;

a sealing member being housed in one of the side cavities adjacent to the blades; and an annular sealing end plate mounted on an upstream or downstream end of the disk, said sealing end plate extending radially between the platforms and the disk, so as to face the slots and the roots of the blades, said sealing end plate including rotary coupling means for coupling with the sealing member, wherein one of the sealing end plate and the sealing member includes a projecting portion and the other of the sealing end plate and the sealing member includes a housing of complementary shape to the projecting portion, the projecting portion being engaged in the housing.

2. A turbine engine wheel according to claim 1, wherein the projecting portion is a peg.

3. A turbine engine wheel according to claim 1, wherein a radially inner periphery of the sealing end plate is fastened to the upstream or downstream end of the disk by a twist-lock type coupling.

4. A turbine engine wheel according to claim 1, wherein the sealing end plate includes an annular lip extending axially upstream.

5. A turbine engine wheel according to claim 1, wherein the blade is made entirely out of a ceramic matrix composite material.

6. A turbine engine wheel according to claim 1, wherein the sealing member is made of metal and is hollow or solid.

7. A turbine engine wheel according to claim 1, wherein a radially outer portion of the sealing end plate bears axially against the sealing member and is spaced apart from the roots and the platforms of the blades.

8. A turbine engine wheel according to claim 1, wherein the sealing end plate includes a seal arranged between the sealing end plate and the disk, radially outside bottoms of the slots for mounting the roots of the blades.

9. A turbine engine wheel according to claim 1, further comprising two annular sealing end plates respectively mounted on the upstream end and the downstream end of the disk, each end plate extending radially between the platforms of the blades and the disk, so as to face the slots and the roots of the blades, at least one of the sealing end plates including the rotary coupling means for coupling with the sealing member.

* * * * *